United States Patent [19]

Le Stang et al.

[11] 4,409,493

[45] Oct. 11, 1983

[54] METHOD AND DEVICE FOR THE TRANSMISSION OF ELECTRIC POWER BETWEEN PARTS TURNING AT LOW SPEED

[75] Inventors: Jean-Claude Le Stang, Toulouse; Georges Thomin, Tolosan, both of France

[73] Assignee: Centre National d'Etudes Spatiales, France

[21] Appl. No.: 277,496

[22] Filed: Jun. 26, 1981

[30] Foreign Application Priority Data

Jun. 27, 1980 [FR] France ..... 80 14381

[51] Int. Cl.[3] ..... H01H 47/00

[52] U.S. Cl. ..... 307/132 R; 307/147; 339/5 M

[58] Field of Search ..... 307/116, 119, 122, 123, 307/132 R, 137, 139, 145, 147; 310/36, 38, 39; 339/5 R, 5 M, 6 R, 8 R

[56] References Cited

U.S. PATENT DOCUMENTS

| | | | |
|---|---|---|---|
| 2,671,864 | 3/1954 | Dargier de St. Voulry | 310/39 |
| 2,933,629 | 4/1960 | Hurler | 310/39 |
| 3,510,670 | 5/1970 | Uhland | 307/137 |
| 3,599,165 | 8/1971 | Wendell | 339/5 M |
| 3,887,254 | 6/1975 | Landis | 339/5 R |

FOREIGN PATENT DOCUMENTS

| | | |
|---|---|---|
| 2249458 | 10/1973 | France . |
| 2187048 | 12/1973 | France . |

*Primary Examiner*—L. T. Hix
*Assistant Examiner*—D. Jennings
*Attorney, Agent, or Firm*—Neil F. Markva

[57] ABSTRACT

Device and method for transmission of electric power between two parts turning at low relative speed. A flexible electrical conductor connects an intermediate part to the turning. A driving device is located between the intermediate part and the turning part with clutching means and electrical switching means disposed between the intermediate and fixed parts. Control means is located between a position detector and the electrical switching means and the clutching means. Thus, when the turning part has been displaced by a certain angle with respect to the fixed part, the electrical connection is displaced so as to cancel the twist which it has undergone because of the rotation of the turning part. The connection between the fixed part and the turning part is then reestablished for another rotation.

14 Claims, 1 Drawing Figure

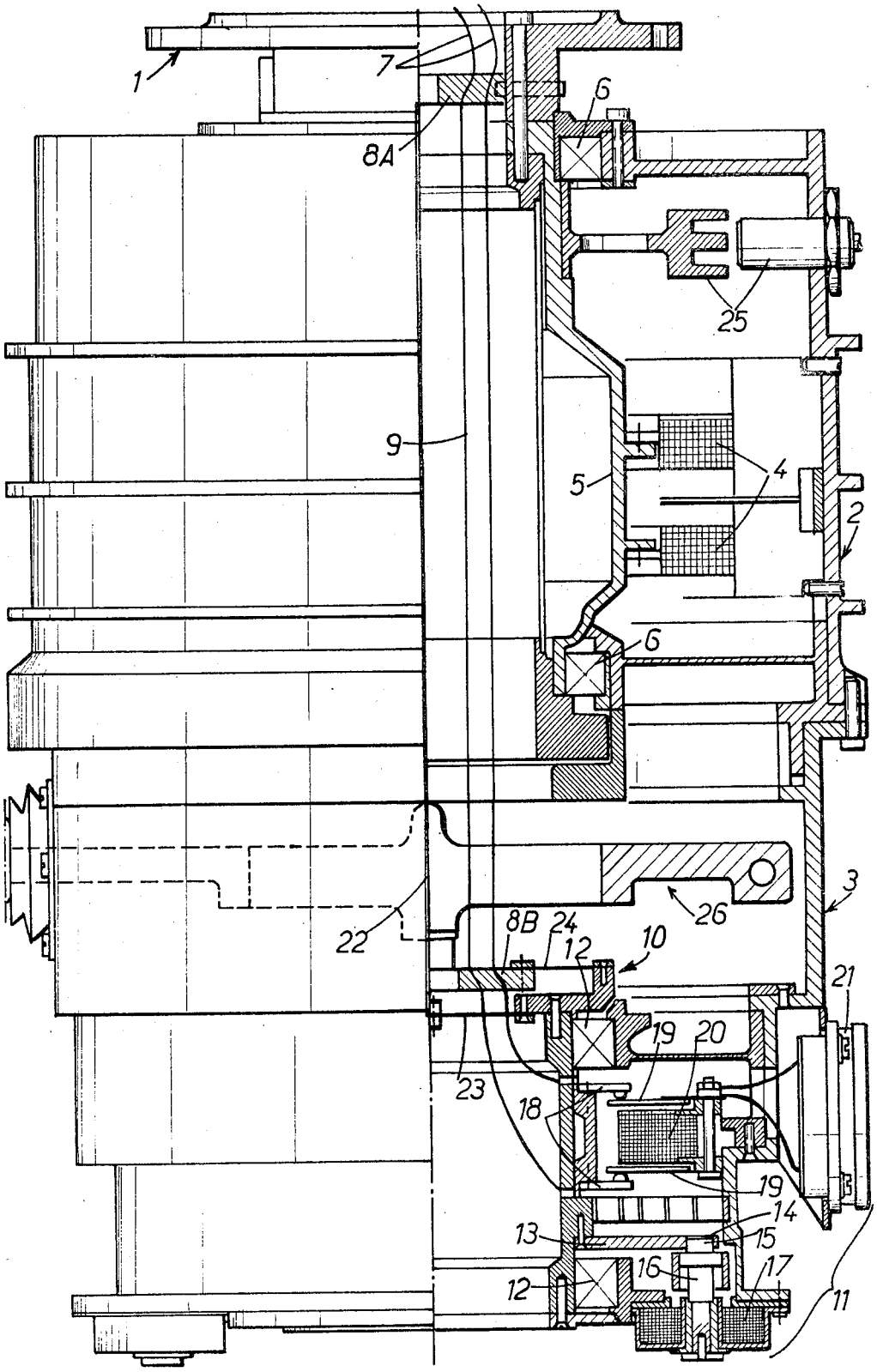
1
7
6
8A
25
9
5
4
2
6
3
26
22
8B
24
12
10
21
19
20
23
18
19
14
13
15
16
17
12
11

METHOD AND DEVICE FOR THE TRANSMISSION OF ELECTRIC POWER BETWEEN PARTS TURNING AT LOW SPEED

FIELD OF THE INVENTION

The invention refers to a method of transmission of electric power between parts turning at low speed and in particular between a fixed part and a turning part, and a device for putting the method into effect.

BACKGROUND OF THE INVENTION

The transmission of electric power between one part turning at low speed and the other fixed, in general necessitates recourse to sliding contacts. This is particularly the case with satellites having alignable solar generators.

These sliding contacts involve numerous disadvantages such as: wear of the contacts, development of the opposing torque, electrical noise, and dissipation by Joule effect in the contacts. These disadvantages are very sharply amplified in the case of operation at very high vacuum.

PURPOSE OF THE INVENTION

The method and the device in accordance with the invention have the aim of palliating the disadvantages stated above, by eliminating the connection by sliding contacts.

The device in accordance with the invention, amongst others enables the quality to be improved, of pictures taken in satellites for observation of the Earth, and in satellites for telecommunication or for direct television, to increase the power transmitted.

SUMMARY OF THE INVENTION

The method of transmission of electric power between a fixed and a turning part consists in effecting a flexible electrical connection between these two parts and then interrupting this connection when the turning part has been displaced by a certain angle with respect to the fixed part. The electrical connection is then displaced so as to cancel the twist which it has undergone because of the rotation of the turning part. Then the connection is reestablished between the fixed part and the turning part for another rotation.

In accordance with a variant upon the method a flexible electrical connection is effected between the turning part and a movable intermediate part. The intermediate part is coupled mechanically and electrically to the fixed part. When the turning part has been displaced by a certain angle with respect to the fixed part, the intermediate part is uncoupled from the fixed part and the intermediate part is made to turn in the direction of rotation of the turning part by an angle equal to the certain angle. The intermediate and fixed parts are then coupled for another rotation.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

The single FIGURE is an elevational view partially in section showing an embodiment of a transmission device for putting into effect the method and the variant upon it described above.

DETAILED DESCRIPTION

This revolving connecting device is placed between the body of a satellite (not shown) and the support for the solar panels. The connecting device includes a fixedly mounted outer casing 2 and a fixedly mounted lower portion 3 which is housed in the satellite. The casing 2 carries driving means 4 which drive the turning part or rotor 5. Rotor 5 is rotably supported in ball-bearings 6 and connected to support flange 1 as shown for rotatably supporting the solar panels. The cables 7 come from cell solar panels (not shown) and are connected to a connector piece or ring 8A which is one turning part of the device. This ring 8A is connected by a flexible electrical connection 9 to a second ring 8B integral with the intermediate part 10 which is capable of turning with respect to the fixed part 11. The electrical connection 9 may be formed of a number of coiled flexible conductors fixed evenly between the two rings 8A and 8B. The intermediate part 10 is mounted upon ball-bearings 12 and carries a crown 13 which exhibits at least one peripheral aperture 14 designed to receive a pin 15 mounted at the end of the movable core 16 of an electromagnet 17 fixed onto the fixed part 11. The crown 13 and the electromagnet 17 form means of clutching between the intermediate part 10 and the fixed part 11. Electrical switching means consisting of electrical contacts 18 are arranged at the periphery of the intermediate part 10 between the intermediate part 10 and the fixed part 11. When intermediate part 10 and fixed part 11 are coupled by the clutch (crown 13 and electromagnet 17), contacts 18 cooperate with contacts 19 carried by the movable armatures of electromagnetic relays 20 located at the inner periphery of the fixed part 11.

The contacts of the relays 20 are connected to a distributor plug 21.

Inorder to cancel the twist in the flexible electrical connection 9, a driving device comprising an elastic member 22 is provided between the turning and intermediate parts. In accordance with the embodiment shown, elastic member 22 is arranged along the axis of the turning part or rotor 5 and intermediate part 10. It is formed, for example, of a threadlike torsion member or a strip.

In accordance with another embodiment the elastic member consists of the flexible connection 9 itself.

In order to enable relative angular displacement between the turning part 5 and the intermediate part 10 without too great forces of axial pull occurring between the two parts, at least one of the ends of the torsion member 22 (when the latter appears in the form of a thread or a strip) and one of the ends of the flexible connection 9 are attached to means capable of elastic elongation, for example, diaphragms for axial deformation 23 and 24.

The angular displacement of the turning part 5 with respect to the fixed part 11 is defined by a position detector 25 arranged between the two parts. In this embodiment detector 25 comprises detector of variation in magnetic field. This detector acts upon the means of control of opening the contacts between the intermediate part 10 and the fixed part 11 as well as upon the clutching means.

Hence the device for the transmission of electric power in accordance with the invention exhibits the following arrangement:

The turning part or rotor 5 is located coaxially inside the fixed casing 2 in which is fixed one part of the driving means 4 for rotating the turning part 5. Coaxially inside the turning part 5, the elastic member 22 and the flexible electrical connection 9 are arranged respectively along the axis and close to the axis. At least one end of the flexible connection 9 and one end of the elastic member 2 is attached to a diaphragm for axial deformation diaphragms 24 and 23, respectively. Diaphragms 23 and 24 are supported by the coaxial intermediate part 10 and partially located inside a zone of the fixed lower portion 3. This zone carries the relay coils 20 and the moving contacts 19 as well as the coil of the electromagnet 17 which constitutes one part of the clutching means. When the device is intended for equipping a satellite, means 26 supports the center of the intermediate part 10.

The transmission of energy by the device described above will necessarily involve an interruption when the turning part 5 has made approximately one turn with respect to the fixed part 11. If this interruption is unacceptable, it will be possible to provide two intermediate parts each turning by half a revolution, the operations of angular recovery of one of the parts being carried out when the other part is in service. The contacts of the relays of each of the parts are then mounted in parallel.

The device having two intermediate parts, by mounting the relays in series- parallel, enables a certain redundancy in the event of failure of one of the devices.

The method of transmission of energy and the device for putting it into effect, by eliminating sliding contacts confer an increase in the working life of the contacts, an increase in the power transmitted and a reduction in the disturbing torques induced by friction when employing sliding contacts.

The reaction torque of the flexible electrical connection and of the driving device is low and reproducible. This has the result of reducing the disturbing effects upon satellite and of increasing certain of its performances such as, for example, the quality of the pictures taken by geostationary satellites.

It is obvious that the devices described may be employed for transmitting electrical energy in any system including two parts in slow relative motion.

We claim:

1. a method of transmitting electrical power between a fixed part and a turning part, said method comprising the steps of:

(a) coupling flexible connecting means at one end thereof to a fixed part and the other end thereof to the turning part, (b) said flexible connecting means including means for transmitting electrical power between the two parts, (c) rotating in a given direction the turning part by a certain angle with respect to the fixed part to cause a twist to form in the electrical transmitting means, (d) interrupting the electrical connection between the said two parts, (e) displacing the flexible connector by the certain angle in a contrary direction to the giving direction to eliminate said twist in the electrical transmitting means, (f) re-connecting the fixed part to the turning part to perform another cycle.

2. A method as defined in claim 1 wherein the turning part includes a movable intermediate part coupled mechanically and electrically to the fixed part, the intermediate part is turned in the direction of rotation by the turning part by an angle equal to said certain angle, the intermediate part is uncoupled when the turning part has been displaced by said certain angle and then rotated in a reverse direction with respect to the fixed part to eliminate said twist, and upon elimination of said twist, the intermediate and fixed parts are coupled mechanically and electrically for another rotation.

3. The method as defined in claim 2 wherein flexible connecting means includes a flexible electrical connection between the turning part and the two movable intermediate parts, and one of the intermediate parts is uncoupled when the other intermediate part is coupled to said fixed part.

4. A device for transmitting electrical power between a fixed part and a turning part, said device comprising:

(a) at least one movable intermediate part, (b) a flexible electrical conductor connecting the intermediate part to the turning part, (c) a driving device located between the intermediate part and the turning part, (d) clutching means for coupling and uncoupling the intermediate part and the fixed part, (e) electrical switching means for electrically connecting and disconnecting the intermediate and fixed parts, (f) a position detector, and (g) control means located between the position detector and the electrical switching means and the clutching means for activating said electrical switching means and said clutching means.

5. A device as defined in claim 4 wherein the driving device includes an elastic means fixed between the turning part and the intermediate part.

6. A device as defined in claim 5 wherein the elastic means includes at least one torsion member.

7. A device as defined in claim 5 wherein the elastic means includes the flexible electrical conductor.

8. A device as defined in claim 5 wherein the elastic means includes an elastic member which carries means capable of elastic elongation in the axial direction at at least one end of the elastic member.

9. A device as defined in claim 4 wherein the flexible electrical conductor carries at at least one end thereof means capable of elastic elongation in the axial direction.

10. A device as defined in claim 9 wherein the axial elongation elastic means includes diaphragms for axial deformation.

11. A device as defined in claim 4 wherein the electrical switching means includes at least one electromagnetic relay controlled by the position detector, fixed contacts of the relays being carried by the intermediate part, corresponding moving contacts and the excitation coil being carried by the fixed part.

12. A device as defined in claim 4 wherein the clutching means include electromagnetic means.

13. A device as defined in claim 14 wherein the turning part is arranged coaxially with the fixed part, driving means are located in the fixed part to drive the turning part, and the flexible electrical conductor and an elastic member are arranged in the turning part close to the axis and along the axis of the turning part, respectively, one end of the flexible electrical conductor and one end of the elastic member being attached each to a diaphraghm for axial deformation, said diaphragm being supported by the intermediate part coaxially inside a zone of the fixed part supporting the electrical switching means and the electrical clutching means.

14. A device as defined in claim 13 wherein the clutching means includes coil and movable armature, and the electrical switching means includes moving contacts and relay coils.

* * * * *